US006663730B2

(12) United States Patent
Coutu

(10) Patent No.: US 6,663,730 B2
(45) Date of Patent: Dec. 16, 2003

(54) MARAGING STEEL AND PROCESS FOR MANUFACTURING A STRIP OR A PART CUT OUT OF A STRIP OF COLD-ROLLED MARAGING STEEL

(75) Inventor: Lucien Coutu, London (GB)

(73) Assignee: Imphy Ugine Precision, Puteaux (FR)

( * ) Notice: Subject to any disclaimer, the term of this patent is extended or adjusted under 35 U.S.C. 154(b) by 0 days.

(21) Appl. No.: 09/988,134

(22) Filed: Nov. 19, 2001

(65) Prior Publication Data

US 2002/0059967 A1 May 23, 2002

(30) Foreign Application Priority Data

Nov. 17, 2000 (FR) ..... 00 14807

(51) Int. Cl.[7] ..... C22C 38/12; C21D 8/02

(52) U.S. Cl. ..... 148/624; 148/547; 148/230; 148/336

(58) Field of Search ..... 148/336, 337, 148/549, 624, 230, 233

(56) References Cited

U.S. PATENT DOCUMENTS

| | | | | | |
|---|---|---|---|---|---|
| 3,178,324 | A | * | 4/1965 | Grange et al. | 148/662 |
| 3,341,372 | A | * | 9/1967 | Sadowski | 148/328 |
| 3,642,595 | A | * | 2/1972 | Saul | 148/336 |
| 5,246,511 | A | * | 9/1993 | Nakamura et al. | 148/328 |
| 5,441,578 | A | | 8/1995 | Couderchon et al. | |
| 5,783,145 | A | | 7/1998 | Coutu et al. | |
| 5,788,783 | A | | 8/1998 | Coutu et al. | |
| 5,792,286 | A | | 8/1998 | Inoue et al. | 148/336 |
| 5,838,080 | A | | 11/1998 | Couderchon et al. | |
| 5,888,848 | A | * | 3/1999 | Cozar et al. | 438/106 |
| 6,146,474 | A | | 11/2000 | Coutu et al. | |
| 6,190,465 | B1 | | 2/2001 | Coutu et al. | |
| 6,214,401 | B1 | | 4/2001 | Chaput et al. | |
| 6,309,474 | B1 | * | 10/2001 | Yagasaki | 148/217 |
| 6,350,293 | B1 | * | 2/2002 | Carter et al. | 266/201 |
| 6,350,324 | B1 | | 2/2002 | Waeckerie et al. | |
| 2001/0006081 | A | * | 12/2000 | Uehara et al. | 148/318 |

FOREIGN PATENT DOCUMENTS

| | | | | |
|---|---|---|---|---|
| EP | 0 931 844 | | 7/1999 | |
| EP | 1 111 080 | | 6/2001 | |
| GB | 936557 | | 9/1963 | |
| JP | 60-234920 | A * | 11/1985 | C21D/9/46 |
| JP | 02285053 | A * | 11/1990 | C22C/38/00 |
| JP | 2000-345302 | * | 12/2000 | C22C/38/00 |

OTHER PUBLICATIONS

Derwent Acc. No. 1976–85468X abstract for JP 50079417 A, published Jun. 27, 1975.*

E112–96e1 Standard Test Method for Determing Average Grain Size (Document Summary) for ASTM International. Copyright 2000. 2 pages.*

Patent Abstracts of Japan, vol. 013, No. 423, Sep. 20, 1989; & JP 01 162726, Jun. 27, 1989.

Patent Abstracts of Japan, vol. 013, No. 399, Sep. 5, 1989 & JP 01 14052, Jun. 2, 1989.

Patent Abstracts of Japan, vol. 013, No. 399, Sep. 5, 1989 & JP 01 142021, Jun. 2, 1989.

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A maraging steel strip or part and process for manufacture of a strip or of a part cut out of a strip of cold-rolled maraging steel and hardened by a hardening heat treatment. In the process, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8. The composition by weight of the maraging steel is: $12\% \leqq Ni \leqq 24.5\%$; $2.5\% \leqq Mo \leqq 12\%$; $4.17\% \leqq Co \leqq 20\%$, Al $\% \leqq 0.15\%$; $Ti \leqq 0.1\%$; $N \leqq 0.003\%$; $Si \leqq 0.1\%$; $Mn \leqq 0.1\%$; $C \leqq 0.005\%$; $S \leqq 0.001\%$; $P \leqq 0.005\%$; $H \leqq 0.0003\%$; $O \leqq 0.001\%$; iron and impurities resulting from smelting, the chemical composition also satisfying the relationships: $20\% \leqq Ni+Mo \leqq 27\%$; $50 \leqq Co \times Mo \leqq 200$; $Ti \times N \leqq 2 \times 10^{-4}$.

49 Claims, No Drawings

MARAGING STEEL AND PROCESS FOR MANUFACTURING A STRIP OR A PART CUT OUT OF A STRIP OF COLD-ROLLED MARAGING STEEL

BACKGROUND OF THE INVENTION

1. Field of the Invention

The present invention relates to a maraging steel that is particularly suitable for the manufacture of parts which must have very good fatigue strength, and to a process for manufacturing a strip or a part cut therefrom.

2. Discussion of the Background

Numerous parts are manufactured from maraging steel strips containing, in % by weight, about 18% of nickel, 9% of cobalt, 5% of molybdenum, 0.5% of titanium and 0.1% of aluminum, and having been treated to achieve an elastic limit of greater than 1800 MPa. These strips are obtained by hot rolling and cold rolling. The strips or parts cut out of the strips are then hardened by hardening heat treatment at around 500° C. The parts are surface-nitrided to improve their fatigue strength. Unfortunately, the fatigue strength of these parts is insufficient.

In order to improve the fatigue strength of the parts, it has been proposed to use maraging steels having different chemical compositions and mechanical characteristics, such as maraging steels containing 18% of nickel, 12% of cobalt, 4% of molybdenum, 1.6% of titanium and 0.2% of aluminum, or maraging steels containing 18% of nickel, 3% of molybdenum, 1.4% of titanium and 0.1% of aluminum, or even maraging steels containing 13% of chromium, 8% of nickel, 2% of molybdenum and 1% of aluminum. None of these steels, however, has yielded satisfactory results, the fatigue strengths always being poorer than that of parts manufactured with the standard steel.

OBJECTS OF THE INVENTION

One object of the present invention is to remedy these problems and to provide a strip or a part of maraging steel having improved fatigue strength.

Another object of the invention is a process for the manufacture of a strip, or a part cut out of a strip, of cold-rolled maraging steel. According to this process, before a hardening heat treatment is performed, the strip or the part is subjected to cold plastic deformation with a degree of working greater than 30% and the strip or the part is subjected to recrystallization annealing in order to obtain a fine-grained structure with ASTM index higher than 8.

DETAILED DESCRIPTION OF THE INVENTION

The preferred chemical composition of the invention steel comprises, in percent by weight based on total weight:

$12\% \leqq Ni \leqq 24.5\%$ $2.5\% \leqq Mo \leqq 12\%$ $4.17\% \leqq Co \leqq 20\%$ $Al \leqq 0.15\%$ $Ti \leqq 0.1\%$ $N \leqq 0.003\%$ $Si \leqq 0.1\%$ $Mn \leqq 0.1\%$ $C \leqq 0.005\%$ $S \leqq 0.001$ $P \leqq 0.005\%$ $H \leqq 0.0003\%$ $O \leqq 0.001$; and iron and impurities resulting from smelting, the chemical composition preferably also satisfying the relationships:

$20\% \leqq Ni+Mo \leqq 27\%$ $50 \leqq Co \times Mo \leqq 200$ $Ti \times N \leqq 2 \times 10^{-4}$ In the invention process, after recrystallization annealing, the strip or the part may be subjected if necessary to cold rolling with a reduction ratio of between 1% and 10%.

Preferably the maraging steel is remelted under vacuum by the VAR process or in a first step is remelted under vacuum by the VAR process or under electrically conductive slag by the ESR process and in a second step is remelted under vacuum by the VAR process.

The invention also relates to a strip or part with thickness of less than 1 mm, of maraging steel having a fine-grained structure with an ASTM index of higher than 8 and an elastic limit after hardening of greater than 1850 MPa.

The strip or the part obtained according to the invention process can be used for the manufacture of parts such as belts. These parts can be hardened by a hardening treatment between 450 and 550° C. for 1 to 10 hours, followed if necessary by surface nitriding.

To manufacture a cold-rolled strip of maraging steel according to the invention, the steel preferably is smelted in such a way as to keep the carbon content below 0.005% and is then deoxidized with aluminum.

The steel smelted in this way can be cast in the form of remelting electrodes. These electrodes are then remelted under vacuum (VAR process, "Vacuum Arc Remelting", which is known in itself) to form ingots or slabs, or in a first step are remelted under vacuum (VAR) or under electrically conductive slab (ESR process, "Electro Slag Remelting", known in itself) to form second electrodes, which themselves are remelted under vacuum (VAR) to form ingots or slabs. Thus either one-stage remelting by VAR or two-stage remelting by VAR+VAR or ESR+VAR is performed. In these remelting operations, the metal is refined and the quality of solidification is improved by reducing segregations. In particular, the sulfur content can be lowered by ESR remelting and the nitrogen and hydrogen contents can be lowered by VAR remelting.

The ingots or slabs are then hot-rolled after being reheated to around 1200° C. and, for example, between 1150° C. and 1250° C., to obtain hot-rolled strips with thicknesses of several millimeters and, for example, thicknesses of about 4.5 mm.

The hot-rolled strips may be pickled then cold-rolled with one or more recrystallization annealing steps to obtain cold-rolled strips with thicknesses of less than 1 mm and, for example, thicknesses of 0.4 mm or of 0.2 mm.

The last intermediate recrystallization annealing treatment is performed at a thickness such that the cold-rolled strip has a degree of working of greater than 30%, and preferably greater than 40%.

The strip worked in this way is annealed, in the through-type furnace, for example, to obtain a fine-grained structure with ASTM index higher than 8 (corresponding to grains with mean diameter smaller than 20 microns) and preferably higher than 10 (corresponding to grains with mean diameter smaller than 10 microns); the grain size being determined per ASTM E112.

The annealing treatment for the purpose of obtaining fine-grained structure is preferably performed under protective atmosphere with appropriately adjusted temperature and duration parameters. These parameters depend on the particular conditions under which the heat treatment is performed, and the person skilled in the art knows how to determine these parameters in each particular case. In the case of a treatment performed in a continuous through-type furnace, the duration (meaning the dwell time of any point of the strip in the furnace) preferably ranges between 10 s and 1 minute, and the setpoint temperature of the furnace is preferably between 900° C. and 1100° C.; the furnace atmosphere can be argon with a dew point preferably lower than −50° C.

In order to improve the flatness of the strip and if necessary to complete the martensitic transformation, the strip can be additionally subjected to light cold rolling with a reduction ratio of between 1% and 10%, thus leading to a degree of working of the same value.

A part can then be cut out of the strip and this part can be formed, for example by bending, after which it can be subjected to a hardening treatment in which it is preferably held at between 450 and 550° C. for 1 to 10 hours. It must be noted that, when the treatment temperature is situated in the upper part of the temperature range (500 to 550° C.), the ductility is improved and the elastic limit is slightly lowered.

The hardening treatment can also be performed in the through-type furnace at a temperature of between 600° C. and 700° C. for a duration of between 30 seconds and 3 minutes.

The resulting product is a part made of a metal having an elevated elastic limit and excellent fatigue strength.

During or after the hardening treatment, the part can be surface-hardened by a nitriding treatment performed by holding for several hours at around 500° C. in a reactive gas mixture with high nitrogen concentration.

In an alternative version, blanks for parts can be cut out of cold-rolled strips having thickness greater than the final thickness desired for the parts. These blanks are formed, welded if necessary then cold-rolled to final thickness in such a way as to achieve a degree of working, of greater than 30% or preferably greater than 40%. The parts are then annealed under the same conditions as described hereinabove, in such a way as to obtain a fine-grained structure with ASTM index higher than 8, or preferably higher than 10, after which they are subjected to a hardening treatment as indicated hereinabove. The elastic limit achieved is high and the fatigue strength is excellent.

Parts can also be manufactured by cutting them out of hardened strips, for example by chemical cutting. The entire process, including the hardening heat treatment, is then applied to the strip. These parts are, for example, support meshes for integrated circuits.

The maraging steel that will preferably be used to achieve very good fatigue properties and an elastic limit higher than 1850 MPa contains mainly, in % by weight:

from 12% to 24.5% of nickel, from 2.5% to 12% of molybdenum, from 4.17% to 20% of cobalt, and iron and low concentrations of impurities or residual elements resulting from smelting. In order to obtain an Ms point (temperature of the beginning of martensitic transformation) close to 200° C., the nickel and molybdenum contents must be such that $20\% \leqq Ni+Mo \leqq 27\%$, and preferably such that $22\% \leqq Ni+Mo \leqq 25\%$.

In order to obtain an elastic limit of higher than 1850 MPa after hardening heat treatment, the cobalt and molybdenum contents must be such that $Co \times Mo \geqq 50$ and preferably such that $Co \times Mo \geqq 70$. In fact, the elastic limit increases with the value of this product. To obtain sufficient ductility, however, the cobalt and molybdenum contents must be such that $Co \times Mo \leqq 200$ and preferably such that $Co \times Mo \leqq 120$. These values correspond respectively to elastic limits lower than about 3000 MPa and 2500 MPa.

Molybdenum has a favorable effect on surface hardening by nitriding. To obtain good hardening, the molybdenum content must preferably be greater than 4%, and especially greater than 6%. Preferably, however, it is kept below 8%, in order to limit segregation problems and to facilitate hot-forming operations as well as to improve the ductility of the final product. Two preferential ranges of molybdenum contents can be defined:

4.17 to 6% of Mo, corresponding to products having very good hot and cold formability as well as a very good compromise between elevated elastic limit and good ductility and fracture strength.

6 to 8% of Mo, corresponding to steels which have very high elastic limit or are more economical because of reduced cobalt content.

By combining all of these conditions, it is possible to define the following preferential composition ranges for the main elements:

1) in order to achieve an elastic limit greater than 1850 MPa and moderate ability to undergo hardening by nitriding:
$17\% \leqq Ni \leqq 20\%$
$4.17\% \leqq Mo \leqq 6\%$
$13\% \leqq Co \leqq 17\%$
$20\% \leqq Ni+Mo \leqq 27\%$
$Co \times Mo \geqq 50$ 2) in order to achieve an elastic limit greater than 1850 MPa and good ability to undergo hardening by nitriding:
$15\% \leqq Ni \leqq 17\%$
$6\% \leqq Mo \leqq 8\%$
$8.75\% \leqq Co \leqq 13\%$
$20\% \leqq Ni+Mo \leqq 27\%$
$Co \times Mo \geqq 50$ 3) in order to achieve an elastic limit greater than 2000 MPa and a more favorable Ms point:
$15\% \leqq Ni \leqq 21\%$
$4.17\% \leqq Mo \leqq 8\%$
$8.75\% \leqq Co \leqq 17.5\%$
$22\% \leqq Ni+Mo \leqq 25\%$
$Co \times Mo \geqq 70$ 4) in order to achieve an elastic limit greater than 2000 MPa and a more favorable Ms point and moderate ability to undergo hardening by nitriding:
$17\% \leqq Ni \leqq 20\%$
$4\% \leqq Mo \leqq 6\%$
$13\% \leqq Co \leqq 17.5\%$
$22\% \leqq Ni+Mo \leqq 25\%$
$Co \times Mo \geqq 70$ 5) in order to achieve an elastic limit greater than 2000 MPa and a more favorable Ms point and good ability to undergo hardening by nitriding:
$15\% \leqq Ni \leqq 17\%$
$6\% \leqq Mo \leqq 8\%$
$8.75\% \leqq Co \leqq 13\%$
$22\% \leqq Ni+Mo \leqq 25\%$
$Co \times Mo \geqq 70$ Besides the main elements whose composition ranges have just been described, the residual elements preferably are rigorously controlled in order to obtain good ductility and fatigue-strength properties. These limits are in particular:

Al≦0.15%

Ti≦0.1%

N≦0.003%

Si≦0.1%

Mn≦0.1%

C≦0.005%

S≦0.001

P≦0.005%

H≦0.0003%

O≦0.001%

For each of these elements, the minimum content can be 0% or traces. Furthermore, and to achieve improved fatigue strength for belts, the nitrogen and titanium contents must be such that $Ti \times N \leqq 2 \times 10^{-4}$, or preferably $\leqq 1 \times 10^{-4}$.

By way of example, and for comparison, strips of maraging steel with the following composition were made:

Ni=18.1%, Co=16.2%, Mo=5.3%, Al=0.020%, Ti=0.013%, Si=0.03%, Mn=0.03%,

C=0.003%, Ca<0.0005%, S=0.0007%, P=0.002, N=0.0023%, O<0.001%, H<0.0001%, the rest being iron and impurities. These impurities are in particular copper and chromium, with contents of Cu=0.07% and Cr=0.06%. The martensitic transformation point Ms of this heat is equal to +195° C.

These strips were cold-rolled to a thickness of 0.4 mm, with a final degree of working of 70%.

A first strip A, given by way of example, was annealed in the through-type furnace under hydrogen at 1020° C. for 1 minute to obtain fine-grained structure with an ASTM index of 11, after which it was hardened by being held at 490° C. for 3 hours.

A second strip B, given by way of comparison, was annealed in the through-type furnace at 1150° C. for 1 minute to obtain coarse-grained structure with an ASTM index of 7, after which it was hardened by being held at 490° C. for 3 hours.

Comparative fatigue-strength tests were performed with strips A and B by pulsating tension at 25 hertz between a maximum stress of 750 MPa and a minimum stress of 75 MPa.

For strip A according to the invention, the fatigue limit was better than $8 \times 10^8$ cycles, whereas for strip B the fatigue limit was equal to $5 \times 10^8$ cycles. These results show the benefit of fine-grained structure for improving the fatigue strength of these strips.

Both strips A and B had an elastic limit higher than 1850 MPa.

In order to demonstrate the special benefit of the preferential chemical composition of the maraging steel according to the invention, another strip of maraging steel was made with the following contents: 18% of nickel, 9% of cobalt, 5% of molybdenum, 0.5% of titanium and 0.1% of aluminum. This strip was manufactured by the process according to the invention, the grain structure had an ASTM index of 10 and the elastic limit was 1910 MPa.

The fatigue limit measured under the same test conditions as in the preceding case was $2 \times 10^8$ cycles.

These strips can be used advantageously to manufacture belts or any other product, such as support meshes for integrated circuits.

By way of example, strips according to the invention were used to make transmission belts for internal combustion engines, the belts comprising links held together by rings made of narrow strips according to the invention, the two ends of the strips being welded together. The useful life of these belts is more than ten times longer than the useful life of identical belts made with strips of maraging steel according to the prior art.

French patent application 0014807 is incorporated herein by reference. Where a range is stated all values and subranges therebetween are included as if written out.

What is claimed is:

1. A process for manufacturing a strip or of a part cut out of a strip of cold-rolled maraging steel and hardened by a hardening heat treatment, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

12%≦Ni≦24.5%

2.5%≦Mo≦12%

4.17%≦Co≦20%

Al≦0.15%

Ti≦0.1%

N≦0.003%

Si≦0.1%

Mn≦0.1%

C≦0.005%

S≦0.001%

P≦0.005%

H≦0.0003%

O≦0.001%; and iron and impurities resulting from smelting, the chemical composition also satisfying the following relationships:

20%≦Ni+Mo≦27%

50≦Co×Mo≦200

$Ti \times N \leqq 2 \times 10^{-4}$.

2. The process of claim 1, wherein the steel composition further satisfies the following relationships:

15%≦Ni≦17%

6%≦Mo≦8%

8.75%≦Co≦13%

20%≦Ni+Mo≦27%

Co×Mo≧50.

3. The process of claim 1, wherein the steel composition further satisfies the following relationships:

15%≦Ni≦21%

4.17%≦Mo≦8%

8.75%≦Co≦17.5%

22%≦Ni+Mo≦25%

Co×Mo≧70.

4. The process of claim 1, wherein the steel composition further satisfies the following relationships:

17%≦Ni≦20%

4%≦Mo≦6%

13%≦Co≦17.5%

22%≦Ni+Mo≦25%

Co×Mo≧70.

5. The process of claim 1, wherein the steel composition further satisfies the following relationships:

17%≦Ni≦20%

4.17%≦Mo≦6%

13%≦Co≦17%

20%≦Ni+Mo≦27%

Co×Mo≧50.

6. The process of claim 1, wherein the degree of working is greater than 40%.

7. The process of claim 1, wherein the ASTM index is higher than 10.

8. The process of claim 1, wherein the hardening heat treatment comprises holding the strip or part between 600° C. and 700° C. for 30 seconds to 3 minutes.

9. A strip or part of maraging steel having a thickness of less than 1 mm, wherein the steel has a fine-grained structure with an ASTM index of higher than 8, and a composition that comprises, in % by weight based on total weight:

$12\% \leqq Ni \leqq 24.5\%$ $2.5\% \leqq Mo \leqq 12\%$ $4.17\% \leqq Co \leqq 20\%$ $Al \leqq 0.15\%$ $Ti \leqq 0.1\%$ $N \leqq 0.003\%$ $Si \leqq 0.1\%$ $Mn \leqq 0.1\%$ $C \leqq 0.005\%$ $P \leqq 0.005\%$ $H \leqq 0.0003\%$ $O \leqq 0.001\%$ iron and impurities resulting from smelting, the steel composition also satisfying the following relationships:

$20\% \leqq Ni+Mo \leqq 27\%$ $50 \leqq Co \times Mo \leqq 200$ $Ti \times N \leqq 2 \times 10^{-4}$, the steel having an elastic limit after hardening of greater than 1850 MPa.

10. A transmission belt comprising a strip or part according to claim 9.

11. A support mesh for integrated circuits comprising a part according to claim 9.

12. The strip or part according to claim 9, wherein the steel composition further satisfies the following relationships:

$15\% \leqq Ni \leqq 17\%$ $6\% \leqq Mo \leqq 8\%$ $8.75\% \leqq Co \leqq 13\%$ $20\% \leqq Ni+Mo \leqq 27\%$ $Co \times Mo \geqq 50$.

13. The strip or part according to claim 9, wherein the steel composition further satisfies the following relationships:

$15\% \leqq Ni \leqq 21\%$ $4.17\% \leqq Mo \leqq 8\%$ $8.75\% \leqq Co \leqq 17.5\%$ $22\% \leqq Ni+Mo \leqq 25\%$ $Co \times Mo \geqq 70$.

14. The strip or part according to claim 9, wherein the steel composition further satisfies the following relationships:

$17\% \leqq Ni \leqq 20\%$ $4\% \leqq Mo \leqq 6\%$ $13\% \leqq Co \leqq 17.5\%$ $22\% \leqq Ni+Mo \leqq 25\%$ $Co \times Mo \geqq 70$.

15. The strip or part according to claim 9, wherein the steel composition further satisfies the following relationships:

$17\% \leqq Ni \leqq 20\%$ $4.17\% \leqq Mo \leqq 6\%$ $13\% \leqq Co \leqq 17\%$ $20\% \leqq Ni+Mo \leqq 27\%$ $Co \times Mo \geqq 50$.

16. The strip or part according to claim 9, wherein the ASTM index is higher than 10.

17. A process for manufacturing a strip or of a part cut out of a strip of cold-rolled maraging steel and hardened by a hardening heat treatment, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

$12\% \leqq Ni \leqq 24.5\%$ $2.5\% \leqq Mo \leqq 12\%$ $4.17\% \leqq Co \leqq 20\%$ $Al \leqq 0.15\%$ $Ti \leqq 0.1\%$ $N \leqq 0.003\%$ $Si \leqq 0.1\%$ $Mn \leqq 0.1\%$ $C \leqq 0.005\%$ $S \leqq 0.001\%$ $P \leqq 0.005\%$ $H \leqq 0.0003\%$ $O \leqq 0.001\%$; and iron and impurities resulting from smelting, the chemical composition also satisfying the following relationships:

$20\% \leqq Ni+Mo \leqq 27\%$ $50 \leqq Co \times Mo \leqq 200$ $Ti \times N \leqq 2 \times 10^{-4}$, wherein after recrystallization annealing, the strip or the part is subjected to cold rolling with a reduction ratio of between 1% and 10%.

18. The process of claim 17, wherein the degree of working is greater than 40%.

19. The process of claim 17, wherein the ASTM index is greater than 10.

20. The process of claim 17, wherein the hardening heat treatment comprises holding the strip or part between 600° C. and 700° C. for 30 seconds to 3 minutes.

21. A strip or part of maraging steel produced by the process according to claim 17.

22. A transmission belt comprising a strip or part of maraging steel produced by the process according to claim 17.

23. A support mesh for integrated circuits comprising a strip or part of maraging steel produced by the process according to claim 17.

24. A process for manufacturing a strip or of a part cut out of a strip of cold-rolled maraging steel and hardened by a hardening heat treatment, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

$12\% \leqq Ni \leqq 24.5\%$ $2.5\% \leqq Mo \leqq 12\%$ $4.17\% \leqq Co \leqq 20\%$ Al≦0.15%

Ti≦0.1%

N≦0.003%

Si≦0.1%

Mn≦0.1%

C≦0.005%

S≦0.001%

P≦0.005%

H≦0.0003%

O≦0.001%; and iron and impurities resulting from smelting, the chemical composition also satisfying the following relationships:

20%≦Ni+Mo≦27%

50≦Co×Mo≦200

$Ti \times N \leqq 2 \times 10^{-4}$, wherein the maraging steel is remelted after smelting under vacuum by the VAR process or in a first step is remelted under vacuum by the VAR process or under electrically conductive slag of the ESP process and in a second step is remelted under vacuum by the VAR process.

25. The process of claim 24, wherein the degree of working is greater than 40%.

26. The process of claim 24, wherein the ASTM index is greater than 10.

27. The process of claim 24, wherein the hardening heat treatment comprises holding the strip or part between 600° C. and 700° C. for 30 seconds to 3 minutes.

28. A process for manufacturing a strip or of a part cut out of a strip of cold-rolled maraging steel and hardened by a hardening heat treatment, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

12%≦Ni≦24.5%

2.5%≦Mo≦12%

4.17%≦Co≦20%

Al≦0.15%

Ti≦0.1%

N≦0.003%

Si≦0.1%

Mn≦0.1%

C≦0.005%

S≦0.001%

P≦0.005%

H≦0.0003%

O≦0.001%; and iron and impurities resulting from smelting, the chemical composition also satisfying the following relationships:

20%≦Ni+Mo≦27%

50≦Co×Mo≦200

$Ti \times N \leqq 2 \times 10^{-4}$, wherein the hardening heat treatment comprises holding the strip or part between 450° C. and 550° C. for 1 to 10 hours.

29. The process according to claim 28, wherein, during or after the hardening heat treatment, the surface of the strip or part is hardened by nitriding.

30. The process of claim 28, wherein the degree of working is greater than 40%.

31. The process of claim 28, wherein the ASTM index is greater than 10.

32. A process for manufacturing a strip or of a part cut out of a strip of cold-rolled maraging steel and hardened by a hardening heat treatment, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

12%≦Ni≦24.5%

2.5%≦Mo≦12%

4.17%≦Co≦20%

Al≦0.15%

Ti≦0.1%

N≦0.003%

Si≦0.1%

Mn≦0.1%

C≦0.005%

S≦0.001%

P≦0.005%

H≦0.0003%

O≦0.001%; and iron and impurities resulting from smelting, the chemical composition also satisfying the following relationships:

20%≦Ni+Mo≦27%

50≦Co×Mo≦200

$Ti \times N \leqq 2 \times 10^{-4}$, wherein the hardening heat treatment is performed in a through furnace at a temperature of between 600° C. and 700° C. for a duration of between 30 seconds and 3 minutes.

33. The process according to claim 32, wherein, after the hardening heat treatment, the surface of the strip or part is hardened by nitriding.

34. The process of claim 32, wherein the degree of working is greater than 40%.

35. The process of claim 32, wherein the ASTM index is greater than 10.

36. A process for manufacturing a strip or of a part cut out of a strip of cold-rolled maraging steel and hardened by a hardening heat treatment, the steel having an elastic limit after hardening of greater than 1850 MPa, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

12%≦Ni≦24.5%

2.5%≦Mo≦12%

4.17%≦Co≦20%

Al≦0.15%

Ti≦0.1%

N≦0.003%

Si≦0.1%

Mn≦0.1%

C≦0.005%

S≦0.001%

P≦0.005%

$H \leqq 0.0003\%$ $O \leqq 0.001\%$; and iron and impurities resulting from smelting, the chemical composition also satisfying the following relationships:

$20\% \leqq Ni+Mo \leqq 27\%$ $50 \leqq Co \times Mo \leqq 200$ $Ti \times N \leqq 2 \times 10^{-4}$.

37. The process according to claim 36, wherein the maraging steel is remelted after smelting under vacuum by the VAR process or in a first step is remelted under vacuum by the VAR process or under electrically conductive slag by the ESR process and in a second step is remelted under vacuum by the VAR process.

38. The process according to claim 36, wherein the hardening heat treatment comprises holding the strip or part between 450° C. and 550° C. for 1 to 10 hours.

39. The process according to claim 38, wherein, during or after the hardening heat treatment, the surface of the strip or part is hardened by nitriding.

40. The process according to claim 36, wherein the hardening heat treatment is performed in a through furnace at a temperature of between 600° C. and 700° C. for a duration of between 30 seconds and 3 minutes.

41. The process according to claim 40, wherein, after the hardening heat treatment, the surface of the strip or part is hardened by nitriding.

42. The process of claim 36, wherein the degree of working is greater than 40%.

43. The process of claim 36, wherein the ASTM index is greater than 10.

44. The process of claim 36, wherein the hardening heat treatment comprises holding the strip or part between 600° C. and 700° C. for 30 seconds to 3 minutes.

45. The process of claim 36, wherein the chemical composition further satisfies the following relationships:

$15\% \leqq Ni \leqq 17\%$ $6\% \leqq Mo \leqq 8\%$ $8.75\% \leqq Co \leqq 13\%$ $20\% \leqq Ni+Mo \leqq 27\%$ $Co \times Mo \geqq 50$.

46. The process of claim 36, wherein the chemical composition further satisfies the following relationships:

$15\% \leqq Ni \leqq 21\%$ $4.17\% \leqq Mo \leqq 8\%$ $8.75\% \leqq Co \leqq 17.5\%$ $22\% \leqq Ni+Mo \leqq 25\%$ $Co \times Mo \geqq 70$.

47. The process of claim 36, wherein the chemical composition further satisfies the following relationships:

$17\% \leqq Ni \leqq 20\%$ $4\% \leqq Mo \leqq 6\%$ $13\% \leqq Co \leqq 17.5\%$ $22\% \leqq Ni+Mo \leqq 25\%$ $Co \times Mo \geqq 70$.

48. The process of claim 36, wherein the chemical composition further satisfies the following relationships:

$17\% \leqq Ni \leqq 20\%$ $4.17\% \leqq Mo \leqq 6\%$ $13\% \leqq Co \leqq 17\%$ $20\% \leqq Ni+Mo \leqq 27\%$ $Co \times Mo \geqq 50$.

49. A process for manufacturing a strip or of a part cut out of a strip of cold-rolled maraging steel and hardened by a hardening heat treatment, the steel having an elastic limit after hardening of greater than 1850 MPa, wherein, before the hardening heat treatment is performed, the strip or the part is subjected to cold plastic deformation with a degree of working greater than 30% and the strip or the part is subjected to recrystallization annealing in order to obtain a fine-grained structure with ASTM index higher than 8, the chemical composition of the steel comprising in % by weight based on total weight:

$12\% \leqq Ni \leqq 24.5\%$ $2.5\% \leqq Mo \leqq 12\%$ $4.17\% \leqq Co \leqq 20\%$ $Al \leqq 0.15\%$ $Ti \leqq 0.1\%$ $N \leqq 0.003\%$ $Si \leqq 0.1\%$ $Mn \leqq 0.1\%$ $C \leqq 0.005\%$ $S \leqq 0.001\%$ $P \leqq 0.005\%$ $H \leqq 0.0003\%$ $O \leqq 0.001\%$; and iron and impurities resulting from smelting, the chemical composition also satisfying the following relationships:

$20\% \leqq Ni+Mo \leqq 27\%$ $50 \leqq Co \times Mo \leqq 200$ $Ti \times N \leqq 2 \times 10^{-4}$, wherein after recrystallization annealing, the strip or the part is subjected to cold rolling with a reduction ratio of between 1% and 10%.

* * * * *